US008430469B2

(12) United States Patent
Nakamura

(10) Patent No.: US 8,430,469 B2
(45) Date of Patent: Apr. 30, 2013

(54) LIQUID DISCHARGING APPRATUS

(75) Inventor: Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 322 days.

(21) Appl. No.: 12/723,815

(22) Filed: Mar. 15, 2010

(65) Prior Publication Data

US 2010/0245435 A1 Sep. 30, 2010

(30) Foreign Application Priority Data

Mar. 25, 2009 (JP) ..... 2009-074232

(51) Int. Cl.

| | |
|---|---|
| ***B41J 29/38*** | (2006.01) |
| ***B41J 2/95*** | (2006.01) |
| ***B41J 2/14*** | (2006.01) |
| ***B41J 2/045*** | (2006.01) |
| ***B41J 2/175*** | (2006.01) |

(52) U.S. Cl.

USPC ..... 347/14; 347/7; 347/47; 347/68; 347/85; 347/93

(58) Field of Classification Search ..... None
See application file for complete search history.

(56) References Cited

U.S. PATENT DOCUMENTS

| | | | | |
|---|---|---|---|---|
| 5,179,389 | A * | 1/1993 | Arai et al. | 347/7 |
| 5,812,156 | A * | 9/1998 | Bullock et al. | 347/19 |
| 6,022,093 | A | 2/2000 | Arai et al. | |
| 6,042,224 | A | 3/2000 | Oda et al. | |
| 6,789,883 | B2 * | 9/2004 | Heim et al. | 347/85 |
| 2003/0107617 | A1 | 6/2003 | Okuda et al. | |
| 2003/0179255 | A1 * | 9/2003 | Mizutani et al. | 347/14 |
| 2005/0018000 | A1 | 1/2005 | Ishihara | |
| 2005/0046679 | A1 * | 3/2005 | Sanada | 347/68 |
| 2005/0151767 | A1 | 7/2005 | Yeh et al. | |

FOREIGN PATENT DOCUMENTS

| | | |
|---|---|---|
| JP | 10-029321 | 2/1988 |
| JP | 5-057865 | 3/1993 |
| JP | 5-057885 | 3/1993 |
| JP | 5-169674 | 7/1993 |
| JP | 9-123453 | 5/1997 |
| JP | 1029321 | 2/1998 |
| JP | 10211715 | 8/1998 |
| JP | 2001-180045 | 7/2001 |
| JP | 2001-334659 | 12/2001 |
| JP | 2002240318 | 8/2002 |
| JP | 2003182107 | 7/2003 |
| JP | 2004-291574 | 10/2004 |
| JP | 2005-007785 | 1/2005 |
| JP | 2005-193686 | 7/2005 |

OTHER PUBLICATIONS

Notice of Decision of Refusal of Japanese Application No. 2009-074232 dated Apr. 3, 2012.

* cited by examiner

*Primary Examiner* — Stephen Meier
*Assistant Examiner* — Alexander C Witkowski
(74) *Attorney, Agent, or Firm* — Frommer Lawrence & Haug LLP

(57) ABSTRACT

There is provided a liquid discharging apparatus including: a liquid discharging head; a cartridge attaching section in which a liquid cartridge is loaded detachably; a liquid channel; a filter provided in the middle of the liquid channel to capture a foreign substance in the liquid; a parameter deciding mechanism which, based on a cumulative use number of the liquid cartridge, decides a value of a predetermined parameter whose value becomes larger as the cumulative use number becomes larger; and a controller controlling the liquid discharging head so as to decrease an amount of the liquid discharged from the liquid discharging head per unit time as the value of the parameter becomes larger. This structure prevents the occurrence of a failure of the discharge of the liquid from nozzles.

12 Claims, 8 Drawing Sheets

LIQUID DISCHARGING APPRATUS

CROSS REFERENCE TO RELATED APPLICATION

The present application claims priority from Japanese Patent Application No. 2009-074232, filed on Mar. 25, 2009, the disclosure of which are incorporated herein by reference in their entirety.

BACKGROUND OF THE INVENTION

1. Field of the Invention

The present invention relates to a liquid discharging apparatus which discharges liquid from nozzles.

2. Description of the Related Art

In a known recording apparatus, in a printer head, a filter is provided in its ink inlet portion into which ink is led from an ink tank, and the filter captures foreign substances in the ink led into the print head from the ink tank to prevent the foreign substances from entering the inside of the print head.

In a recording apparatus in which a filter is provided in the middle of a channel extending from an ink tank to a printer head, when the filter is clogged by foreign substances due to a large amount of the foreign substances deposited on the filter, channel resistance of the ink channel becomes high. As the channel resistance of the ink channel becomes higher, an amount of the ink supplied to the print head per unit time becomes smaller. When an amount of the ink discharged from the print head per unit time is kept constant, an increase in the channel resistance of the ink channel may cause the occurrence of an ink discharge failure, because an amount of the ink discharged from the print head becomes larger than an amount of the ink supplied to the printer head.

SUMMARY OF THE INVENTION

It is an object of the present invention to provide a liquid discharge apparatus of which ink discharge failure due to the clogging of a filter can be prevented.

According to an embodiment of the present invention, there is provided a liquid discharging apparatus which discharges a liquid filled in a liquid storage chamber formed in a liquid cartridge, the apparatus including:

a liquid discharging head having a plurality of nozzles which are formed in the liquid discharge head and through which the liquid is discharged;

a cartridge attaching section which is connected to the liquid discharging head and in which the liquid cartridge filled with the liquid to be supplied to the liquid discharging head is attached detachably;

a liquid channel extending from the cartridge attaching section to the nozzles;

a filter provided on the liquid channel at an intermediate portion thereof to capture a foreign substance existing in the liquid in the liquid channel;

a parameter determining mechanism which, based on a cumulative usage number of the liquid cartridge, determines a value of a predetermined parameter, a value of which becomes larger as the cumulative usage number becomes larger; and a controller which controls the liquid discharging head to decrease an amount of the liquid discharged from the liquid discharging head per unit time as the value of the parameter becomes larger.

When the liquid is supplied from the liquid cartridge to the liquid discharging head, foreign substances in the liquid are captured by the filter to be deposited on the filter. When the cumulative usage number of the liquid cartridge becomes larger, a channel resistance becomes higher due to the deposited foreign substances and accordingly an amount the liquid supplied from the liquid cartridge to the liquid discharging head per unit time decreases. Therefore, when an amount of the liquid discharged from the liquid discharging head per unit time is always constant, the discharge amount exceeds an amount of the liquid supplied to the liquid discharging head per unit time, which leads to a liquid discharge failure in the nozzles.

In this disclosure, the cumulative usage number of the liquid cartridge based on which a clogging degree of the filter is estimatable is used, and the value of the predetermined parameter whose value becomes larger as the cumulative usage number becomes larger is decided, and as the value of the parameter increases, an amount of the liquid discharged from the liquid discharging head per unit time is decreased. Therefore, it is possible to decrease an amount of the liquid discharged per unit time according to the clogging degree of the filter. As a result, it is possible to prevent the occurrence of the liquid discharge failure in the nozzles.

Here, by filtrating the liquid to capture the foreign substances by using a filter having holes with a predetermined size in a manufacturing process of the liquid, it is possible to capture almost all the foreign substances with the certain size or larger in the liquid. On the other hand, in a manufacturing process of a liquid cartridge casing, foreign substances adhering to a surface of a liquid storage space of the casing can only be removed or captured by cleaning the casing, and this method has a difficulty in completely removing foreign substances with a certain size or larger, unlike the method of removing foreign substances in the liquid by using the filter. That is, it is thought that almost all the foreign substances in the liquid in the liquid cartridge are those adhering to the casing in the manufacturing process of the casing of the liquid cartridge. Therefore, using the cumulative usage number of the liquid cartridge as a basis for estimating the clogging degree of the filter enables more accurate estimation of the clogging degree of the filter than using a consumption amount of the liquid.

It should be noted that, in the present application, "detecting the temperature of the liquid" not only means detecting the temperature of the liquid directly but also includes detecting the temperature of the liquid indirectly, for example, detecting the temperature of another portion having a certain correlation with the temperature of the liquid. Further, in the present application, "simultaneously discharging liquid droplets" is not limited to discharging the liquid droplets precisely simultaneously but includes discharging the liquid droplets in a predetermined discharge cycle.

According to the present invention, since an amount of the liquid discharged from the liquid discharging head per unit time is decreased as the cumulative use number of the liquid cartridge is larger, it is possible to prevent the occurrence of a liquid discharge failure ascribable to the clogging of the filter.

DETAILED DESCRIPTION OF THE PREFERRED EMBODIMENT

Hereinafter, a preferred embodiment of the present invention will be explained.

Figure 1:
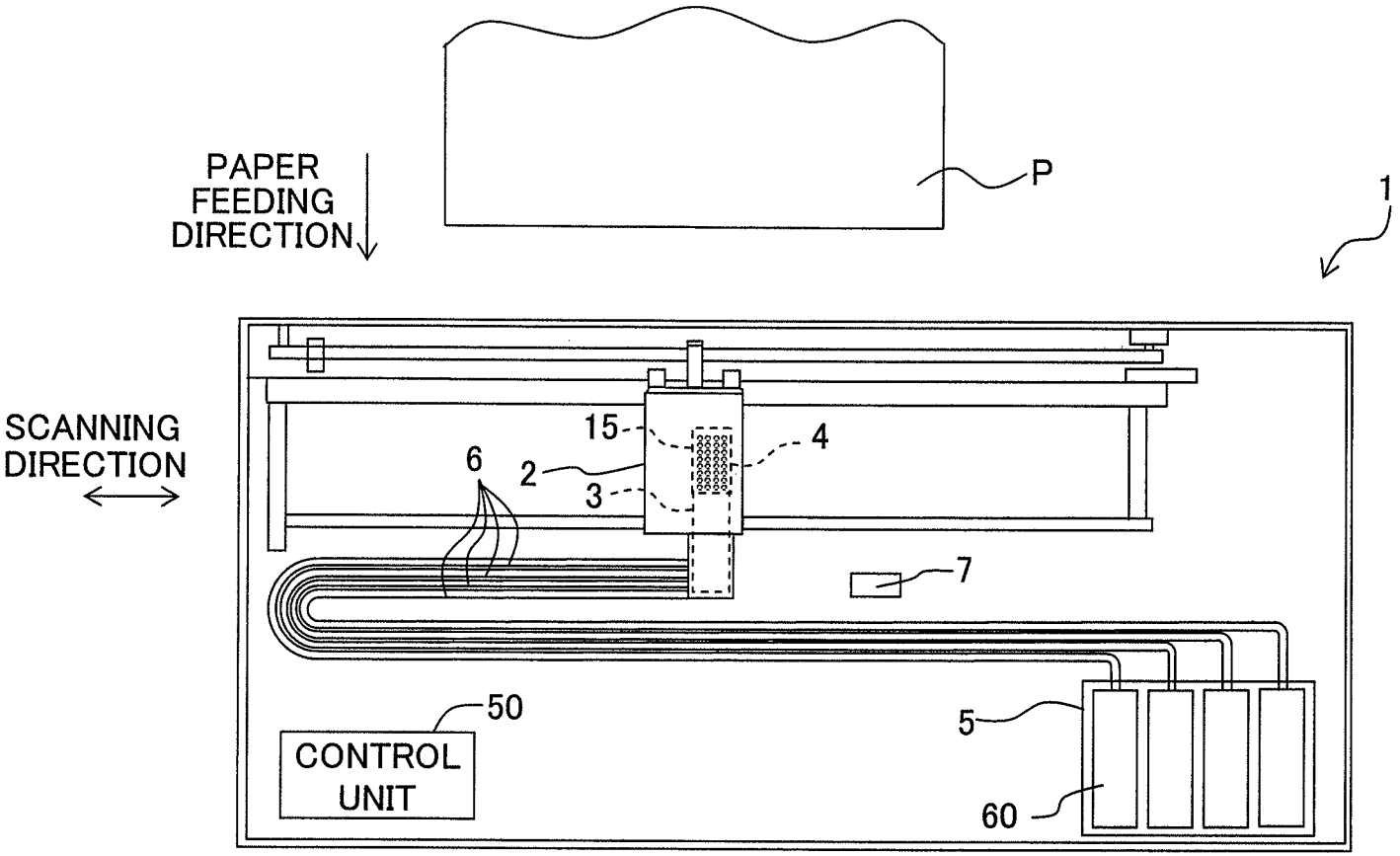
FIG. 1 is a schematic structural view of a printer according to an embodiment of the present invention.

As shown in FIG. 1, a printer 1 (liquid discharge apparatus) has a carriage 2 (moving mechanism), a sub-tank 3, an ink-jet head 4 (liquid discharge head), a cartridge attaching section 5, tubes 6, a temperature detecting device (a temperature sensor) 7, a control unit 50 which controls the operation of the printer 1, and so on. In FIG. 1, nozzles 15 (to be described later) of the ink-jet head 4 are illustrated in an enlarged manner.

The carriage 2 reciprocates in a right and left direction in FIG. 1 (scanning direction). The sub-tank 3 is mounted on the carriage 2. The ink jet head 4 is disposed on a lower surface of the sub-tank 3, and is supplied with inks from the sub-tank 3 to discharge the inks from the plural nozzles 15 (see FIG. 3) formed on its lower surface.

In the printer 1, the cartridge attaching section 5 is disposed in its right lower end portion in FIG. 1, and four ink cartridges 60 filled with black, yellow, cyan, and magenta inks respectively which are to be discharged from the ink-jet head 4 are attachably/detachably disposed in the cartridge attaching section 5.

Here, the ink cartridge 60 attached in the cartridge attaching section 5 will be explained. The scanning direction and a paper feed direction shown in FIG. 2 refer to directions in a state where the ink cartridge 60 is attached in the cartridge attaching section 5.

Figure 2:
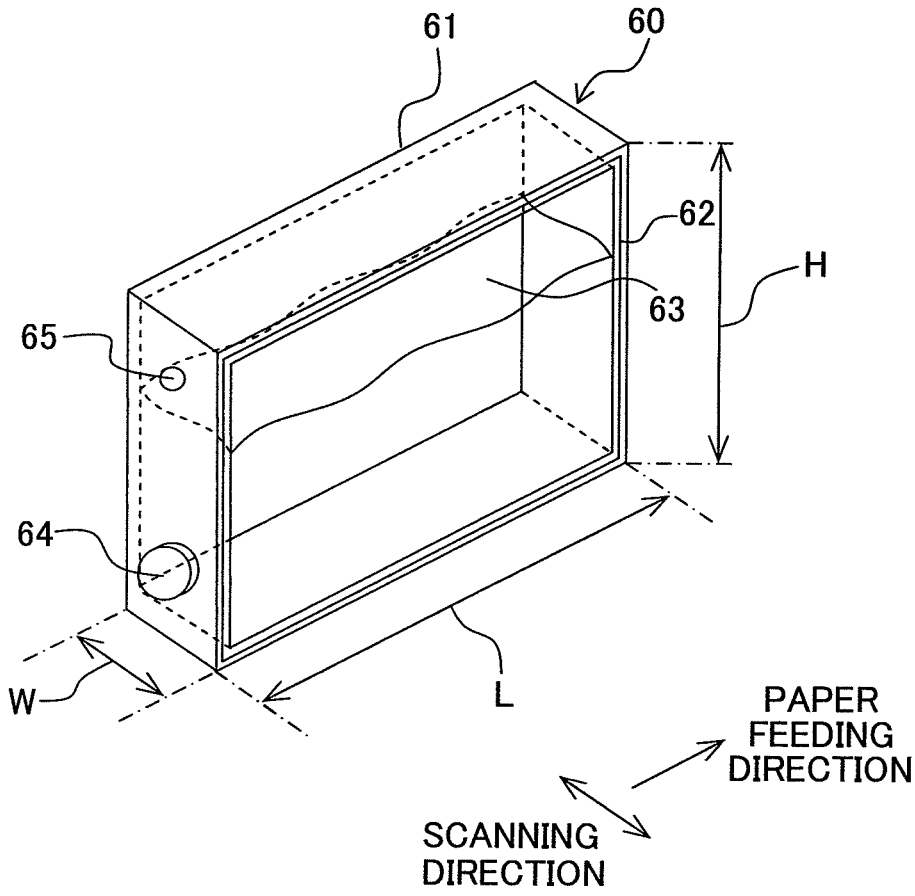
FIG. 2 is a schematic structural view of an ink cartridge in FIG. 1.

As shown in FIG. 2, the ink cartridge 60 has a substantially rectangular parallelepiped shape, and includes a frame 61 which defines an inner space thereof and two openings at both ends in the scanning direction; and films 62 which is adhered on both side surfaces of the frame 61 in the scanning direction so as to seal the openings of the space. In other words, the openings of the frame 61 are closed by the films 62. Consequently, a closed space is formed inside the frame 61, and the closed space functions as an ink storage chamber 63 which stores the ink.

Further, an ink supply section 64 and an atmosphere communication section 65 are formed, on one side surface of the frame 61 in the paper feed direction, near lower and upper end portions thereof, respectively. When the ink cartridge 60 is attached in the cartridge attaching section 5, the ink supply section 64 is connected to the tube 6 and the ink is supplied to the tube 6 from the ink supply section 64. Then, when the ink in the ink storage chamber 63 reduces due to the supply of the ink from the ink supply section 64 to the tube 6, air in an amount corresponding to a reduced amount of the ink flows into the ink storage chamber 63 from the atmosphere communication section 65.

Further, as the ink cartridges 60, four kinds (small, medium, large, extra-large) of the ink cartridges 60 different in size shown in Table 1 can be detachably attached in the aforesaid cartridge attaching part 5. Table 1 shows the specifications (ink storage amount, size of the ink storage chamber, surface area of the ink storage chamber, surface area of the films) of the four kinds of the ink cartridges 60 attachable in the cartridge attaching section 5, and also shows relative values of the ink storage amount (capacity) and the surface area of the ink storage chamber 63 relative to those of the medium-sized ink cartridge 60 which are set as 1.

TABLE 1

| kind of cartridge | ink storage amount (ml) | size of ink storage chamber W (mm) | H (mm) | L (mm) | surface area of ink storage chamber ($mm^2$) | surface area of film ($mm^2$) | ink storage amount (rel. value) | area of film (rel. value) | wt. |
|---|---|---|---|---|---|---|---|---|---|
| small | 2.5 | 10 | 30 | 25 | 2600 | 1500 | 0.5 | 1.0 | 1.0 |
| medium | 5.0 | 10 | 30 | 25 | 2600 | 1500 | 1 | 1 | 1.0 |
| large | 10.0 | 15 | 30 | 35 | 4050 | 2100 | 2.0 | 1.4 | 1.4 |
| extra large | 20.0 | 20 | 30 | 50 | 6200 | 3000 | 4.0 | 2.0 | 2.0 |

The tubes 6 connect the sub-tank 3 and the cartridge attaching section 5, and the inks in the ink cartridges 60 attached in the cartridge attaching section 5 are supplied to the ink-jet head 4 via the tubes 6 and the sub-tank 3.

The temperature detecting device 7 detects temperature near an area of the printer 1 where the temperature sensor 7 is disposed. Here, when the temperature in the printer 1 changes, temperature of the inks in the printer 1 also changes. That is, the temperature sensor 7 detects the temperature in the printer 1 having a certain correlation with the temperature of the inks. It should be noted that the position where the temperature sensor 7 is disposed is not limited to the position shown in FIG. 1 and the temperature sensor 7 may be disposed at any position where it can detect the temperature of any of areas of the printer 1 whose temperature changes according to the temperature of the inks. Alternatively, the temperature sensor 7 may directly detect the temperature of the inks.

In the printer 1, the ink jet head 4 reciprocating in the scanning direction with the carriage 2 discharges the inks to a recording paper P conveyed in the paper feeding direction (downward in FIG. 1) by a paper transporting mechanism (not shown), whereby printing on the recording paper P is performed.

Next, the ink-jet head 4 will be explained.

Figure 3:
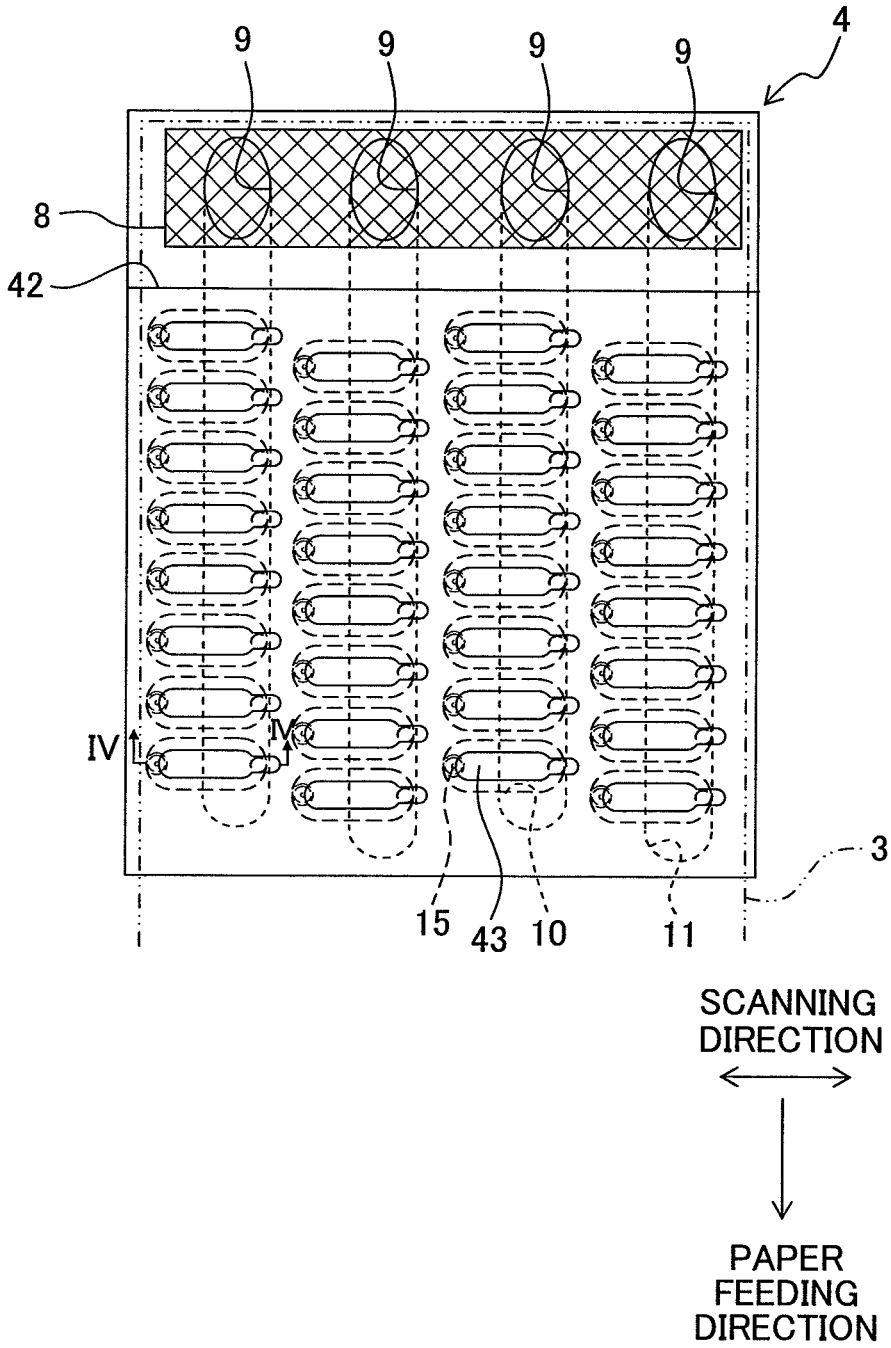
FIG. 3 is a plane view of an ink-jet head in FIG. 1.
Figure 4:
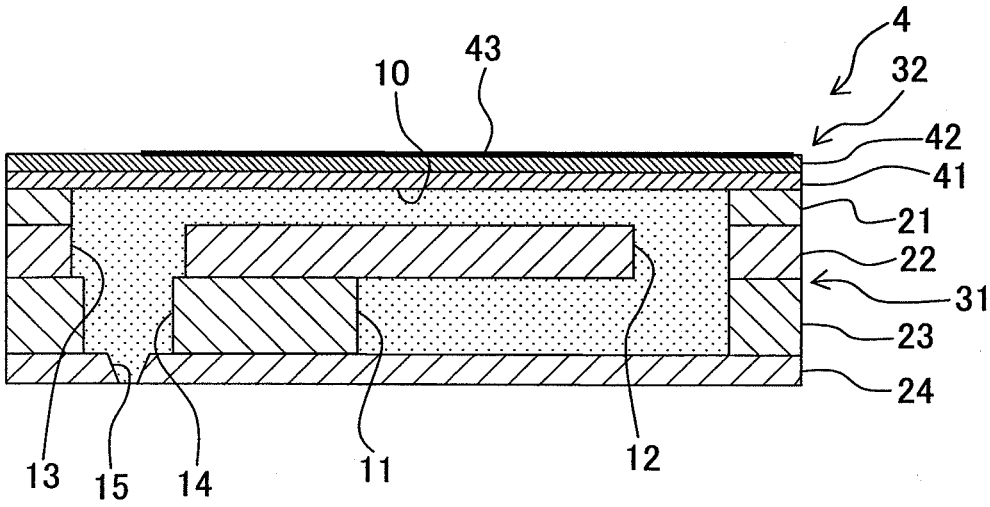
FIG. 4 is a sectional view taken along IV-IV line in FIG. 3.

As shown in FIGS. 3 and 4, the ink-jet head 4 includes: a channel unit 31 in which ink channels including pressure chambers 10 and the nozzles 15 are formed; and a piezoelectric actuator 32 which applies a pressure to the inks in the pressure chambers 10.

The channel unit 31 includes a cavity plate 21, a base plate 22, a manifold plate 23, and a nozzle plate 24, and these four plates are stacked one on another. The three plates 21 to 23 except the nozzle plate 24 are made of a metal material such as stainless steel, and the nozzle plate 24 is made of a synthetic resin material such as polyimide. Alternatively, the nozzle plate 24 may also be made of a metal material similarly to the other three plates 21 to 23.

In the cavity plate 21, the plural pressure chambers 10 each having a substantially elliptical shape which is long in the scanning direction in a plane view are formed. In other words, a longitudinal axis of each of the pressure chambers 10 having the substantially elliptical shape is parallel to the scanning direction. The pressure chambers 10 are arranged in the paper feeding direction to form one row of the pressure chambers 10, and four such rows of the pressure chambers 10 are arranged in the scanning direction. In the base plate 22, a plurality of through holes 12, 13 each having a substantially circular opening are formed in its portions facing both longitudinal ends of the pressure chambers 10 in a plane view.

In the manifold plate 23, four manifold channels 11 are formed. The manifold channels 11 are provided so as to correspond to the aforesaid four rows of the pressure chambers 10, and each of the manifold channels 11 extends in the paper feed direction so as to face substantially right half portions of the pressure chambers 10 forming the single row of the pressure chambers 10. Further, the manifold channels 11 are supplied with the inks from four ink supply ports 9 which are provided at positions facing upper end portions in FIG. 3 and are connected to the sub-tank 3. In more detail, the black, yellow, cyan, and magenta inks are supplied through the four ink supply ports 9 in order from the left in FIG. 3.

On a connection portion between the ink supply ports 9 and the sub-tank 3, a filter 8 is provided. The filter 8 has a plurality of minute holes to capture (remove) foreign substances in the inks larger than the holes, and the inks from which the foreign substances have been captured by the filter 8 are supplied to the ink-jet head 4. This can prevent the foreign substances from entering into the ink-jet head 4.

Further, in the manifold plate 23, a plurality of through holes 14 each having a substantially circular opening are formed at portions facing the through holes 13 in a plane view. In the nozzle plate 24, the nozzles 15 are formed in portions facing the through holes 14 in a plane view. Similarly to the pressure chambers 10, the nozzles 15 are arranged in the paper feeding direction, thereby forming one nozzle row. Further, four such nozzle rows are arranged in the scanning direction, and the black, yellow, cyan, and magenta inks are discharged from the nozzles 15 in order from those forming the left nozzle row.

In the channel unit 31, the manifold channels 11 communicate with the pressure chambers 10 via the through holes 12, and the pressure chambers 10 communicate with the nozzles 15 via the through holes 13, 14. In this manner, in the channel unit 31, the individual ink channels extending from the manifold channels 11 to the nozzles 15 via the pressure chambers 10 are formed.

The piezoelectric actuator 32 includes a vibration plate 41, a piezoelectric layer 42, and individual electrodes 43. The vibration plate 41 is made of a metal material such as stainless steel and is joined to an upper surface of the channel unit 31 so as to cover the pressure channels 10. Further, the conductive vibration plate 41 also serves as a common electrode which is used for driving the piezoelectric actuator 32 in cooperation with the individual electrodes 43 as will be described later and is constantly kept at ground potential.

The piezoelectric layer 42 is made of a piezoelectric material whose main component is lead zirconate titanate which is a mixed crystal of lead titanate and lead zirconate and is continuously disposed on an upper surface of the vibration plate 41 so as to spread over all the pressure chambers 10.

Figure 5:
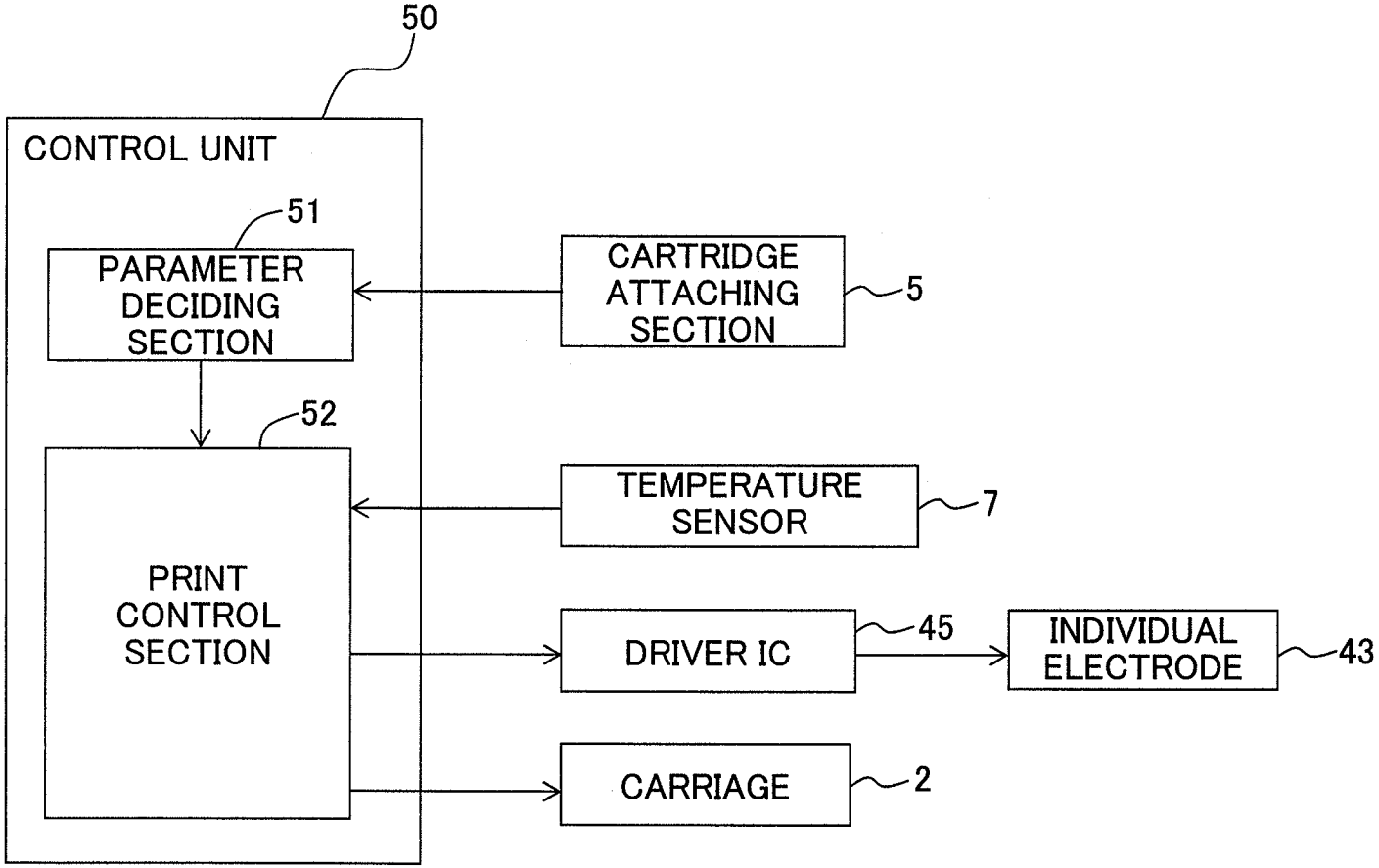
FIG. 5 is a block diagram of a control unit in FIG. 1.

The individual electrodes 43 each have a substantially elliptical shape slightly smaller than the pressure chamber 10 and are disposed on portions, of an upper surface of the piezoelectric layer 42, facing substantially center portions of the pressure chambers 10. Further, the individual electrodes 43 are connected to a driver IC 45 (see FIG. 5) via a flexible wiring member (FPC) (not shown), and the driver IC 45 applies driving potentials individually to the individual electrodes 43.

Further, in the aforesaid piezoelectric layer 42, portions sandwiched by the individual electrodes 43 and the vibration plate 41 serving as the common electrode are polarized in its thickness direction (direction from the individual electrode 43 toward the vibration plate 41).

Here, a driving method of the piezoelectric actuator 32 will be explained. In the piezoelectric actuator 32, the individual electrodes 43 are kept at the ground potential in advance by the driver IC 45. Then, when the driver IC 45 applies the driving potential to one of the individual electrodes 43, there occurs a potential difference between this individual electrode 43 and the vibration plate 41 as the common electrode kept at the ground potential, so that an electric field in the thickness direction which is the same as the polarization direction is generated in the portion, of the piezoelectric layer 42, sandwiched by these electrodes. Consequently, this portion of the piezoelectric layer 42 contracts in a horizontal direction perpendicular to the thickness direction, and as a result, the vibration plate 41 and the piezoelectric layer 42 deform together so as to bulge (deform) toward the pressure chamber 10 side. This deformation reduces the volume of the pressure chamber 10 to increase the pressure of the ink in the pressure chamber 10, so that the ink is discharged from the nozzle 15 communicating with the pressure chamber 10.

Next, the controller 50 which controls the operation of the printer 1 will be explained. The controller 50 includes a Central Processing Unit (CPU), a Read Only Memory (ROM), a Random Access Memory (RAM), and so on, and they operate as a parameter determining section 51, a print control section 52, and so on.

Every time the ink cartridge 60 is attached in the cartridge attaching section 5, the parameter determining section 51 accumulates a value weighted according to the kind of the attached ink cartridge 60, and the cumulative value is defined as a value of a cumulative usage number parameter $\alpha$.

Here, a larger weighting amount is given to the ink cartridge 60 as a surface area of the films 62 of the ink cartridge 60 is larger, with a weighting amount of the ink cartridge 60 of the medium-sized ink cartridge 60 set as 1 (reference) as shown in Table 1. That is, the parameter determining section 51 determines the value of the cumulative usage number parameter $\alpha$ so that its value becomes larger as a cumulative usage number of the ink cartridges 60 is larger. Further, the parameter determining section 51 determines the value of the cumulative usage number parameter $\alpha$ while adjusting a value to be added, according to the kind of the ink cartridge 60. That is, when the ink cartridge 60 of which films 62 being wall surfaces of the ink storage chamber 63 have a larger surface area is attached, a value given a larger weight is added to the cumulative usage number parameter $\alpha$.

The print control section 52 controls the operations of the carriage 2 and the driver IC 45 (ink-jet head 4) at the time of the printing in the printer 1, based on the temperature detected by the temperature sensor 7 and the value of the cumulative usage number parameter $\alpha$ determined by the parameter determining section 51.

As shown in Table 2, when the value of the cumulative usage number parameter $\alpha$ is less than 10 ($\alpha<10$), the driver IC 45 is caused to apply the driving potential with a predetermined driving frequency to the individual electrode 43, irrespective of the temperature detected by the temperature sensor 7, that is, in order to cause the discharge of the ink from the nozzle 15, the ink-jet head 4 is driven with the predetermined driving frequency.

In a case where the value of the cumulative usage number parameter α is not less than 10 and less than 20 ($10 \leqq \alpha < 20$), the control is changed as follows according to the temperature detected by the temperature sensor 7. In this case, when the temperature detected by the temperature sensor 7 is equal to or higher than 15° C., the ink-jet head 4 is driven with the above predetermined driving frequency, and when the temperature is lower than 15° C., the driving frequency is lowered by 10% and a moving speed of the carriage 2 is lowered by 10% in accordance with the decrease in the driving frequency.

Further, when the value of the cumulative usage number parameter α is not less than 20 and less than 30 ($20 \leqq \alpha < 30$), and when it is equal to or more than 30 ($\alpha \geqq 30$), the control is also changed as follows according to the temperature detected by the temperature sensor 7. In the case where the value of the cumulative usage number parameter α is not less than 20 and less than 30, when the temperature detected by the temperature sensor 7 is equal to or higher than 15° C., the driving frequency is lowered by 10%, and when the temperature is lower than 15° C., the driving frequency is lowered by 20%. Further, in the case where the value of the cumulative use number parameter α is equal to or larger than 30, when the temperature detected by the temperature sensor 7 is equal to or higher than 15° C., the driving frequency is lowered by 50%, and when the temperature is lower than 15° C., the driving frequency is lowered by 60%. In any of these cases, the moving speed of the carriage 2 is lowered in accordance with the decrease in the driving frequency.

TABLE 2

| cumulative use number | driving frequency | |
|---|---|---|
| parameter α | 15° C. or over | lower than 15° C. |
| $\alpha < 10$ | as normal | as normal |
| $10 \leqq \alpha < 20$ | as normal | 10% decrease |
| $20 \leqq \alpha < 30$ | 10% decrease | 20% decrease |
| $30 \leqq \alpha$ | 50% decrease | 60% decrease |

Here, in this embodiment, when the value of the cumulative usage number parameter α reaches about 50, it is expected that the filter 8 is almost completely clogged and the inks hardly be supplied more to the ink-jet head 4.

In Table 2, a threshold value of the temperature detected by the temperature sensor 7 is set as 15° C., but the threshold value can be appropriately changed according to, for example, a correlation between the temperature and viscosity of the inks, or the like.

Further, the ranges of the cumulative usage number parameter α as a reference for determining the driving frequency and the decrease ratios of the driving frequency are examples and are not limited to those shown in Table 2.

Here, in this embodiment, the foreign substances in the inks captured by the filter 8 are deposited on the filter 8, and therefore, as the cumulative usage number of the ink cartridges 60 becomes larger, an amount of the foreign substances and the like deposited on the filter 8 increases. As a result, the filter 8 is clogged to a larger degree and channel resistance thereof increases.

Further, in the filter 8, the minute holes are formed so as to be capable of capturing the foreign substances in the inks. Therefore, in the ink channel extending from the cartridge attaching section 5 to the ink-jet head 4, channel resistance of the filter 8 is especially high compared with that of other portions. Therefore, the channel resistance of the filter 8 has a great influence on the channel resistance of the whole ink channel and influences an amount of the ink supplied to the sub-tank 3 and the ink-jet head 4 per unit time. Further, as the cumulative usage number of the ink cartridges 60 increases, an amount of the foreign substances deposited on the filter 8 increases. Therefore, as the cumulative usage number of the ink cartridges 60 increases, an amount of the inks supplied to the sub-tank 3 and the ink-jet head 4 per unit time decreases.

Suppose that the ink-jet head 4 is constantly driven with a constant driving frequency irrespective of the cumulative usage number of the ink cartridges 60 and an amount of the inks discharged from the ink-jet head 4 per unit time is always constant. In this case, when the channel resistance of the filter 8 becomes high due to an increase in the cumulative usage number of the ink-cartridges 60, an amount of the inks discharged from the ink-jet head 4 per unit time becomes larger than an amount of the inks supplied to the ink-jet head 4 per unit time, which may lead to a risk of the occurrence of an ink discharge failure.

Here, a possible solution to prevent the occurrence of such an ink discharge failure may be to make the inside diameter of each of the tubes 6 large to decrease the channel resistance of the whole ink channel, but this increases the volume of the ink channel in the tubes 6, resulting in a larger amount of the inks staying in the tubes 6.

In this embodiment, as the value of the cumulative usage number parameter α increases, the driving frequency of the ink-jet head 4 is lowered. Therefore, as an amount of the inks supplied to the ink-jet head 4 per unit time decreases due to an increase in the channel resistance of the filter 8, an amount of the inks discharged from the ink-jet head 4 per unit time is decreased. This can prevent the occurrence of the ink discharge failure.

Further, decreasing the driving frequency makes it possible to easily decrease an amount of the inks discharged from the ink-jet head 4 per unit time.

Here, it is also conceivable that a cumulative ink consumption amount, that is, a cumulative value of an ink storage amount in the ink cartridges 60 is used as the parameter, instead of the cumulative usage number of the ink cartridges 60, and the driving frequency of the ink jet head 4 is determined based on the parameter.

However, in a manufacturing process of the inks, by using a filter having holes with a predetermined size to filtrate the ink and capture foreign substances, it is generally possible to capture almost all the foreign substances with the predetermined size or larger in the liquid. On the other hand, in a manufacturing process of the casing (the frame 61 and the films (resin films) 62) of the ink cartridge, foreign substances sometimes adhere to a surface defining a liquid storage space in the casing, and the adhering foreign substances can only be removed or captured by cleaning the casing. This method has a difficulty in completely removing the foreign substances with a certain size or larger, unlike the method of removing the foreign substances in the ink by using the filter. From this, it is inferred that the foreign substances in the liquids in the ink cartridges 60 are those adhering to the casings of the ink cartridges 60 in the manufacturing process of the casings.

Therefore, when the value of the parameter is determined based on the ink consumption amount and the driving frequency of the ink-jet head 4 is determined based on the value of the parameter, it cannot be said that the value of the parameter accurately corresponds to the clogging degree of the filter 8, which sometimes causes the occurrence of the ink discharge failure or a decrease in the driving frequency of the ink-jet head 4 even though the filter 8 is not clogged. Therefore, the method of determining the value of the parameter based on the cumulative usage number of the ink cartridges 60 more accurately corresponds to the clogging degree of the filter 8.

Further, as shown in Table 1, in the ink cartridges 60, the ink storage amount (capacity) of the ink storage chamber 63 correlates to the surface area of the wall surface of the ink storage chamber 63, but is not proportional to the surface area of the wall surface of the ink storage chamber 63. Further, areas to which the aforesaid foreign substances adhere during the manufacture of the casing of the ink cartridge 60 are surfaces of the frame 61 and the films 62, and the foreign substances are more likely to remain on the films 62 that are more likely to be influenced by static electricity or the like than on the frame 61.

Therefore, by setting the weighting amount of the ink cartridge 60 larger as the surface area of the ink storage chamber 63 of the ink cartridge 60, in particular, the surface area of the films 62 is larger as previously described, the value of the cumulative use number parameter $\alpha$ accurately corresponds to the clogging degree of the filter 8. Incidentally, in a case of a resin ink cartridge not using the films, a value added to the cumulative usage number parameter $\alpha$ may be weighted according to an area of the inside of the ink storage chamber, that is, according to an area of a resin portion in contact with the ink. Further, a weight given to the value added to the cumulative usage number parameter $\alpha$ when the ink cartridge using the films is attached may be set larger than that when a resin ink cartridge not using the films is attached.

Further, the inks each have a higher viscosity as the temperature becomes lower, and therefore, as the temperature of the inks is lower, their flow resistance is higher and an amount of the inks supplied to the ink jet head 4 per unit time is smaller. Therefore, by increasing a decrease amount of the driving frequency as the temperature of the inks is lower, it is possible to more surely prevent the aforesaid occurrence of the ink discharge failure.

Next, modification examples in which various changes are made to this embodiment will be explained. Note that those having the same structures as those of this embodiment are denoted by the same reference numerals and symbols and explanation thereof will be omitted when appropriate.

In the above-described embodiment, the method to decrease an amount of the inks discharged from the ink-jet head 4 per unit time is to lower the driving frequency of the ink-jet head 4, but is not limited to this.

First Modification

In a first modification, in order to decrease an amount of the inks discharged from the ink-jet head 4 per unit time, the number of the nozzles 15 discharging the inks simultaneously in one movement (in one scanning) of the ink-jet head 4 in the scanning direction is decreased.

Figure 6A:
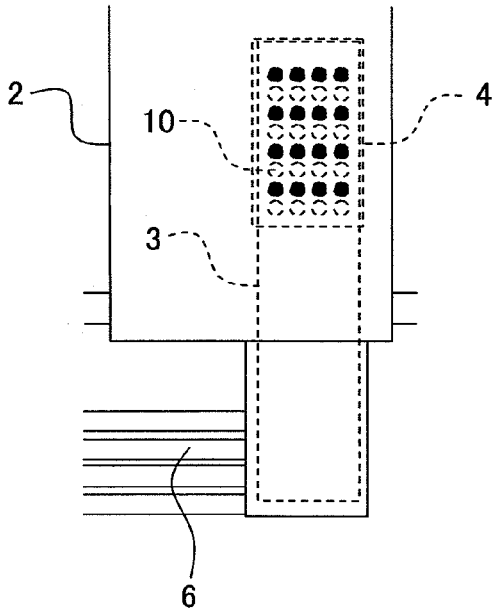
FIG. 6A is a view showing nozzles discharging inks when the ink-jet head is scanned toward one side of a scanning direction.

When the value of the cumulative use number parameter $\alpha$ exceeds a predetermined threshold value, the following control is performed without the driving frequency being decreased. First, the ink-jet head 4 is moved by the carriage 2 toward one side of the scanning direction, and as shown in FIG. 6A, the inks are discharged only from the odd-numbered nozzles 15 from the top in the ink-jet head 4 (the nozzles 15 painted black in FIG. 6A). Subsequently, the ink jet head 4 is moved toward the opposite side of the scanning direction, and as shown in FIG. 6B, the inks are discharged only from the even-numbered nozzles 15 from the top in the ink-jet head 4 (the nozzles 15 painted black in FIG. 6B) for printing.

It is also possible to decrease an amount of the inks discharged per unit time in this case, and therefore, when the channel resistance of the filter 8 increases due to an increase in the cumulative usage number of the ink cartridges 60, it is possible to prevent the occurrence of the ink discharge failure in the ink-jet head 4. Thus decreasing the number of the nozzles 15, through which the inks are discharged simultaneously, makes it possible to easily decrease an amount of the inks discharged from the ink jet head 4 per unit time.

Methods to decrease the number of the nozzles 15, through which the inks are discharged simultaneously, include the following methods. First, the ink jet head 4 is moved by the carriage 2 toward one side of the scanning direction, and the inks are discharged only from the odd-numbered nozzles 15 of the ink-jet head 4 when counted from the top. Thereafter, the recording paper P is transported by a length substantially equal to an interval between the nozzles 15 in the paper feed direction, subsequently, the ink-jet head 4 is moved by the carriage 2 toward the opposite side of the scanning direction, and the inks are discharged only from the odd-numbered nozzles 15 from the top in the ink-jet head 4 in FIGS. 6A and 6B. This can also decrease the number of the nozzles 15 discharging the inks simultaneously.

Figure 6B:
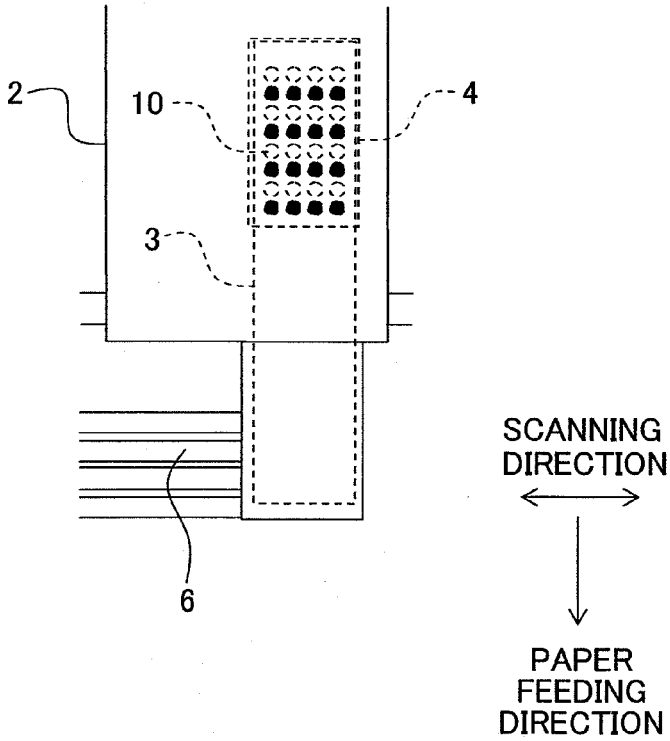
FIG. 6B is a view showing nozzles discharging the inks when the ink-jet head is scanned toward the other side of the scanning direction.

Another alternative method for decreasing the number of the nozzles 15, through which the inks are discharged simultaneously, may be to discharge the inks from only the even-numbered nozzles 15 of the ink-jet head 4 in FIGS. 6A and 6B when counted from the top.

Figure 7:
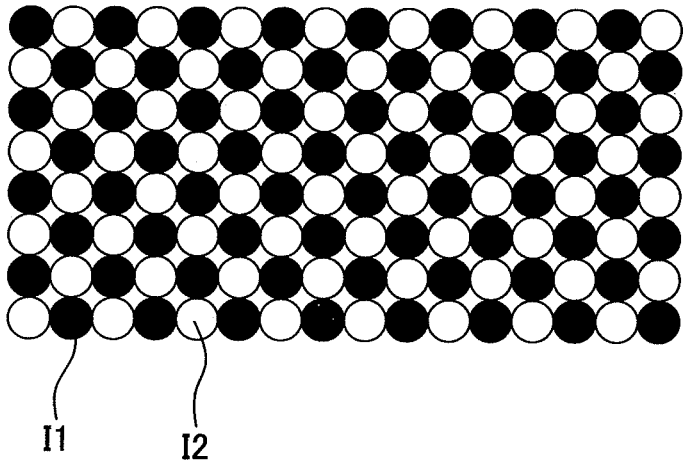
FIG. 7 is a view showing landing positions of ink droplets in a first modification example.

Further, as shown in FIG. 7, the ink jet head 4 is moved by the carriage 2 toward one side of the scanning direction and the inks are discharged alternately from the odd-numbered nozzles 15 and the even-numbered nozzles 15 from the top in the ink-jet head 4 so that ink droplets I1 land. Thereafter, the ink-jet head 4 is moved by the carriage 2 toward the opposite side of the scanning direction, and the inks are discharged alternately from the even-numbered nozzles 15 and the odd-numbered nozzles 15 from the top in the ink-jet head 4 so that ink droplets I2 land. This can also decrease the number of the nozzles 15 simultaneously discharging the inks.

Second Modification

In a second modification, the number of times of discharging the ink from each of the nozzle 15 of the ink-jet head 4 while the ink jet head 4 is moved in the scanning direction from one end to the other end of its movement range is decreased.

Figure 8A:
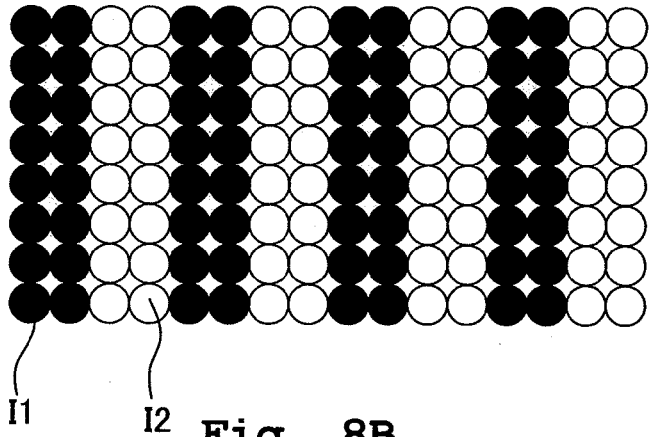
FIG. 8A, FIG. 8B, and to FIG. 8C are views showing landing positions of ink droplets in first, second, and third examples of a second modification example.

As shown in FIG. 8A, when the value of the cumulative usage number parameter $\alpha$ exceeds a predetermined threshold value, while the ink-jet head 4 is moved by the carriage 2 toward one side of the scanning direction from one end to the other end of its movement range, the inks are discharged from the nozzles 15, without the driving frequency being decreased. In this manner, only ink droplets I1 painted black in FIG. 8A are made to land on the recording paper P, and subsequently, while the ink-jet head 4 is moved toward the opposite side of the scanning direction, the inks are discharged from the nozzles 15 so that only ink droplets I2 not painted black in FIG. 8A land.

Figure 8B:
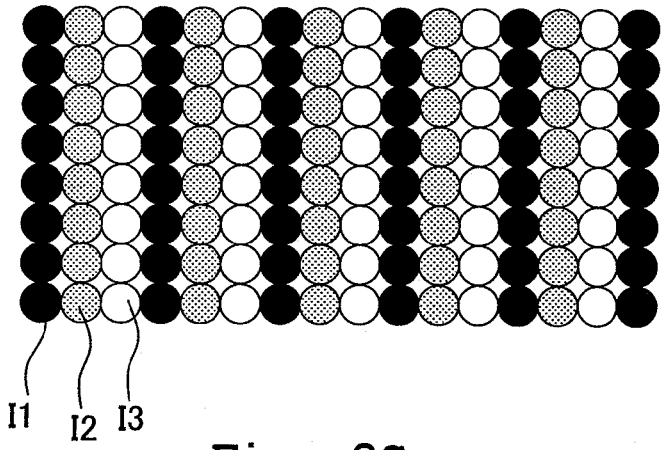

Other methods to decrease the number of times of discharging the ink from each of the nozzles 15 of the ink-jet head 4 while the ink jet head 4 is moved in the scanning direction from one end to the other end of its movement range include the following methods. As shown in FIG. 8B, while the ink-jet head 4 is first moved by the carriage 2 toward one side of the scanning direction from one end to the other end of its movement range, the inks are discharged from the nozzles 15. In this manner, ink droplets I1 painted black in FIG. 8B are made to land on the recording paper P. Subsequently, while the ink-jet head 4 is moved toward the other side of the scanning direction from one end to the other end of its movement range, the inks are discharged from the nozzles 15. In this manner, ink droplets I2 hatched (dotted) in FIG. 8B are made to land. Finally, while the ink-jet head 4 is again moved toward the one side of the scanning direction, the inks are discharged from the nozzles 15 so that ink droplets I3 not painted black in FIG. 8B land.

Figure 8C:
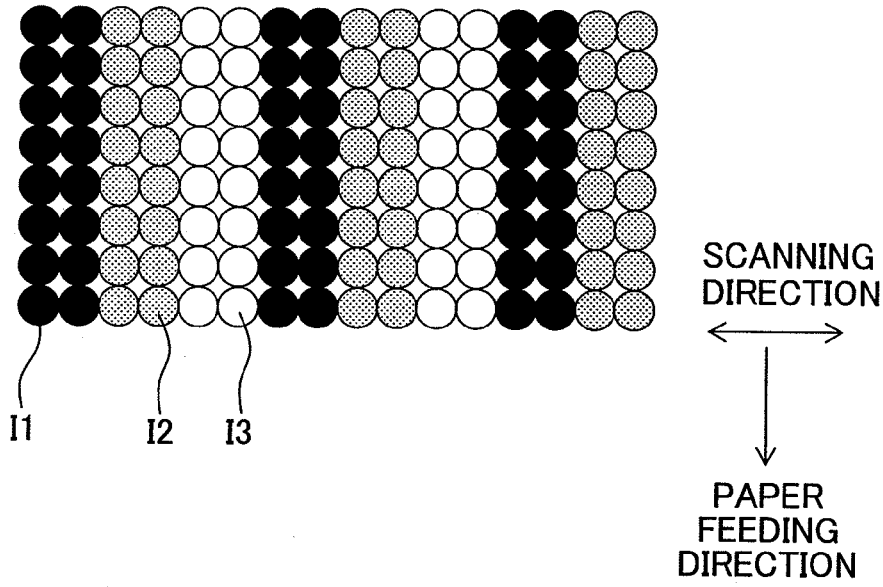

Landing positions when the ink droplets I1 to I3 are made to land in three steps as described above are not limited to those in FIG. 8B, and may be positions shown in FIG. 8C, for instance.

In any of the cases, it is possible to decrease an amount of the inks discharged per unit time. Therefore, it is possible to prevent the occurrence of the ink discharge failure in the ink-jet head 4 when the channel resistance of the filter 8 increases due to an increase in the cumulative usage number of the ink cartridges 60. Further, by decreasing the number of times each of the nozzles 15 of the ink-jet head 4 discharges the ink while the ink jet head 4 is moved in the scanning direction from one end to the other end of its movement range, it is possible to easily decrease an amount of the inks discharged from the ink-jet head 4 per unit time.

Third Modification

In a third modification, as the value of the cumulative usage number parameter $\alpha$ increases, a time interval, after the completion of the discharge of the inks from the nozzle 15 while the ink-jet head 4 is moved by the carriage 2 toward one side of the scanning direction and before the start of the next discharge of the inks from the nozzles 15 while the ink-jet head 4 is moved toward the other side of the scanning direction, is made longer.

Here, a deceleration time, after the completion of the discharge of the inks from the nozzles 15 while the ink-jet head 4 is moved toward one side of the scanning direction at a predetermined speed at a position facing the recording paper P and before an instant when the carriage 2 is stopped at a position not facing the recording paper P, is defined as a first deceleration time, and an acceleration time, in which the carriage 2 stopping at the position not facing the recording paper P is accelerated to a predetermined speed before the inks are discharged from the nozzles 15 while the ink-jet head 4 is moved left toward the other side of the scanning direction at a predetermined speed at the position facing the recording paper P, is defined as a first acceleration time. Further, a deceleration time, after the completion of the discharge of the inks from the nozzles 15 while the ink jet head 4 is moved toward the other side of the scanning direction at the predetermined speed at the position facing the recording paper P and before an instant when the carriage 2 is stopped at a position not facing the recording paper P, is defined as a second deceleration time, and an acceleration time, in which the carriage 2 stopping at the position not facing the recording paper P is accelerated to a predetermined speed before the inks are discharged from the nozzles 15 while the ink-jet head 4 is moved toward the one side of the scanning direction at a predetermined speed at the position facing the recording paper P, is defined as a second acceleration time. By varying the acceleration speed of the carriage 2, the first acceleration time and deceleration time may be set longer than the second acceleration time and deceleration time.

Further, after the completion of the movement of the ink jet head 4 toward the one side of the scanning direction, the next movement in the other side of the scanning direction may be started after a predetermined waiting time passes, and after the completion of the movement toward the other side, the next movement toward the one side may be started immediately.

Alternatively, after the movement of the ink-jet head 4 toward the one side of the scanning direction is completed and after its movement toward the other side is completed, the next movement is started after the waiting time passes in any of the cases, and the waiting time after the completion of the movement toward the one side is made longer than the waiting time after the completion of the movement toward the other side.

Further, at least one of the aforesaid deceleration time, acceleration time, and waiting time during a period, after the completion of the discharge of the inks from the nozzles 15 while the ink-jet head 4 is moved toward one side of the scanning direction and before the start of the next discharge of the inks from the nozzles 15 while the ink-jet head 4 is moved toward the other side of the scanning direction, may be made longer than the aforesaid deceleration time, acceleration time, or waiting time during a period from the completion of the discharge of the inks from the nozzles 15 while the ink-jet head 4 is moved toward the other side of the scanning direction up to the start of the next discharge of the inks from the nozzles 15 while the ink-jet head 4 is moved toward the one side of the scanning direction.

In this case, it is also possible to decrease an amount of the inks discharged per unit time, which can prevent the occurrence of the ink discharge failure in the ink-jet head 4 when the cumulative use number of the ink cartridges 60 increases. Further, by increasing the time from the completion of the discharge of the inks from the nozzles 15 while the ink-jet head 4 is moved toward one side of the scanning direction up to the start of the next discharge of the inks from the nozzles 15 while the ink-jet head 4 is moved toward the other side of the scanning direction, it is possible to easily decrease an amount of the inks discharged from the ink-jet head 4 per unit time.

Fourth Modification

In a fourth modification, the ink-jet head 4 is controlled so that as the value of the cumulative usage number parameter $\alpha$ becomes larger, smaller liquid droplets are discharged from the ink-jet head 4 in one scanning, and a necessary amount of the liquid droplets is dividedly discharged in a plurality of times of the scanning.

In this explanation, a case where the ink-jet head 4 is capable of discharging three kinds of large, medium, and small liquid droplets is taken as an example. When the value of the cumulative usage number parameter $\alpha$ becomes large, the medium-sized liquid droplets may be discharged in two times of scanning, instead of discharging the large sized liquid droplets, and when the value of the cumulative usage number parameter $\alpha$ becomes still larger, the small-sized liquid droplets may be discharged in three times of the scanning instead of discharging the large sized liquid droplets. In this manner, as the value of the cumulative usage number parameter $\alpha$ becomes larger, the liquid droplets with a small volume is dividedly discharged a plurality of times instead of discharging the liquid droplets with a large volume. In this case, it is also possible to decrease an amount of the inks discharged from the ink-jet head 4 per unit time.

Further, in the above-described embodiment, every time the ink cartridge 60 is attached in the cartridge attaching section 5, the value weighted according to the kind of the ink cartridge 60 is accumulated, and the cumulative value thereof is determined as the value of the cumulative usage number parameter α, but this is not restrictive, and the cumulative usage number itself of the ink cartridges 60 may be set as the value of the cumulative usage number parameter α.

In such a case where the ink supply section 64 includes a portion made of a material such as a rubber material to which foreign substances easily adhere, an amount of foreign substances produced in this portion and entering the inks is larger than an amount of foreign substances adhering to the frames 61 and the films 62 during the manufacture of the casings (frames 61, films 62) of the ink cartridges 60. Further, the structure of the ink supply section 64 is generally the same, whatever the kind of the ink cartridge 60 is, and therefore, in determining the cumulative usage number parameter α, by setting the cumulative usage number itself of the ink cartridges 60 as the value of the cumulative usage number parameter α without any weighting according to the kind of the ink cartridge 60 as is done in the above-described embodiment, the value accurately corresponds to the clogging degree of the filter 8.

Further, in the above-described embodiment, a decrease amount of the driving frequency is changed based on the temperature detected by the temperature sensor 7, but the driving frequency may be changed only according to the value of the cumulative usage number parameter α. In this case, the temperature sensor 7 may not be provided necessarily.

In the above-described embodiment, the filter 8 is provided in the connection portion between the sub-tank 3 and the ink-jet head 4, but this is not restrictive. For example, the filter 8 may be provided inside the sub-tank 3, may be provided in the middle of the tubes 6, or may be provided in a portion, of the ink channel formed in the ink-jet head 4, near the connection portion with the sub-tank 3. Thus, the filter 8 only needs to be provided in the middle of the ink channel extending from the cartridge attaching section 5 to the nozzles 15. However, the filter is preferably provided at a portion having a large cross sectional area, in the middle of the ink channel, so as not to cause the clogging of the ink channel.

Further, in the above-described embodiment, the cartridge attaching section 5 is connected to the sub-tank 3 and the ink jet head 4 via the tubes 6, and the inks in the ink cartridges 60 are supplied to the sub-tank 3 and the ink-jet head 4 via the tubes 6, but this is not restrictive. The cartridge attaching section may be provided on the carriage 2 and the inks in the ink cartridges 60 may be supplied to the sub-tank 3 and the ink-jet head 4 without going through the tubes.

Further, in the foregoing explanation, the ink-jet head 4 is a so-called serial-type ink-jet head discharging the inks while moving in the scanning direction with the carriage 2, but this is not restrictive, and the ink-jet head may be a so-called line head which extends along the entire widthwise length of the recording paper P and is fixed to the printer 1.

When the ink-jet head is the line head, a driving frequency of the line head may be lowered, for instance, or printing may be performed in such a manner that, after the inks are discharged only from a half of the nozzles of the line head, the recording paper P is not transported, and after the inks are discharged only from the remaining half of the nozzles, the recording paper P is conveyed (the number of the nozzles discharging the inks simultaneously is decreased). In either case, it is possible to decrease an amount of the inks discharged from the line head per unit time.

In the foregoing explanation, an amount of the inks discharged per unit time is decreased, but since printing quality is not lowered, a printing speed lowers. However, this is not restrictive, and the printer may be structured such that printing quality is lowered while an amount of the inks discharged per unit time is decreased, so as not to lower the printing speed. For example, a printing mode allowing the print control section 52 to lower the printing quality may be selectable by a user. Further, in printing such as printing only of text or FAX printing in which no great problem occurs even if a resolution of an image to be printed slightly lowers, the print control part 52 may automatically lower the printing quality at the time of the printing. At this time, without changing a transporting speed of the recording paper P, an amount of the inks discharged from the ink-jet head 4 per unit time may be decreased as the value of the cumulative usage number parameter α increases.

Further, in the above explanation, the common threshold value of the cumulative usage number parameter α is set for the respective color inks, but this is not restrictive, and the threshold value may be set individually for each of the color inks. For example, having low visibility, the yellow ink has a small influence on printing quality even if a slight failure in its discharge occurs due to the clogging of the filter. Therefore, the threshold value for the yellow ink is set higher than the threshold value for the other inks, and the above-described control may be performed only when the clogging degree of the filter for the yellow ink becomes greater than that of the filters for the other inks.

Incidentally, when a pigment ink is used, fine clods sometimes float in the ink due to the aggregation of pigments. Therefore, when the pigment ink is used, the filter is more likely to be clogged than when a dye ink is used. Therefore, when the pigment ink is used in the above-described embodiment and modification examples, a larger weight may be given to the value added to the cumulative usage number parameter α than when the dye ink is used.

Further, in the foregoing, the example where the present invention is applied to the printer discharging the ink from the ink-jet head is explained, but the present invention is also applicable to a liquid discharging apparatus discharging liquid other than ink from nozzles.

What is claimed is:

1. A liquid discharging apparatus which discharges a liquid filled in a liquid storage chamber formed in a liquid cartridge, the apparatus comprising:

a liquid discharging head having a plurality of nozzles which are formed in the liquid discharging head and through which the liquid is discharged;

a cartridge attaching section which is connected to the liquid discharging head and in which the liquid cartridge filled with the liquid to be supplied to the liquid discharging head is attached detachably;

a liquid channel extending from the cartridge attaching section to the nozzles;

a filter provided on the liquid channel at an intermediate portion thereof to capture a foreign substance existing in the liquid in the liquid channel;

a parameter determining mechanism which, based on a cumulative usage number of the liquid cartridge corresponding to a number of change of the liquid cartridge, determines a value of a parameter, a value of which becomes larger as the cumulative usage number becomes larger; and a controller which controls the liquid discharging head to decrease an amount of the liquid discharged from the liquid discharging head per unit time as the value of the parameter becomes larger.

2. The liquid discharging apparatus according to claim 1;

wherein the controller controls the liquid discharging head to discharge the liquid from the nozzles with a driving frequency, and to lower the driving frequency as the value of the parameter becomes larger.

3. The liquid discharging apparatus according to claim 1, further comprising:

a moving mechanism which is controlled by the controller and which moves the liquid discharging head in a scanning direction;

wherein the controller controls the liquid discharging head and the moving mechanism to discharge the liquid from the nozzles while causing the moving mechanism to more the liquid discharging head in the scanning direction, and to decrease a number of nozzles simultaneously discharging the liquid as the value of the parameter becomes larger.

4. The liquid discharging apparatus according to claim 1, further comprising:

a moving mechanism which is controlled by the controller and which moves the liquid discharging head in a scanning direction;

wherein the controller controls the liquid discharging head and the moving mechanism to discharge the liquid from the nozzles while causing the moving mechanism to move the liquid discharging head in the scanning direction, and to decrease a number of times of discharging the liquid from the nozzles in a time period during which the liquid discharging head is moved in the scanning direction by a distance, as the value of the parameter becomes larger.

5. The liquid discharging apparatus according to claim 1, further comprising:

a moving mechanism which is controlled by the controller and which moves the liquid discharging head in a scanning direction;

wherein the controller controls the liquid discharging head and the moving mechanism to discharge the liquid from the nozzles while causing the moving mechanism to move the liquid discharging head in the scanning direction, and to increase a time period, as the value of the parameter becomes larger, the time period being duration of time after completion of a discharge of the liquid from the nozzles in a moving period during which the liquid discharging head is moved toward one side of the scanning direction, and before a next discharge of the liquid from the nozzles while the liquid discharging head is moved toward another side of the scanning direction.

6. The liquid discharging apparatus according to claim 1, further comprising:

a temperature sensor which detects a temperature of the liquid;

wherein the controller controls the liquid discharging head to decrease an amount of the liquid discharged from the liquid discharging head per unit tune as the temperature detected by the temperature sensor is lower.

7. The liquid discharging apparatus according to claim 1;

wherein the cartridge attaching section is configured such that a plurality of kinds of liquid cartridges, in which liquid storage chambers storing the liquid of different volumes are formed, is attachable; and wherein the parameter determining mechanism gives a weight to the cumulative usage number of each of the liquid cartridges according to the kinds of the liquid cartridges such that a larger weight is given to a liquid cartridge among the liquid cartridges attached to the cartridge attaching section, in which a surface area of a wall surface of the liquid storage chamber is larger than that given to other liquid cartridge.

8. The liquid discharging apparatus according to claim 7;

wherein when a part of the wall surface defining the liquid storage chamber is made of a resin film, the parameter determining mechanism gives a weight to the cumulative usage number of the liquid cartridge according to the kinds of the liquid cartridges such that a larger weight is given to the liquid cartridge, in which a surface area of the part of the wall surface of the liquid storage chamber is larger than that given to other liquid cartridge.

9. The liquid discharging apparatus according to claim 1, further comprising:

a moving mechanism which is controlled by the controller and which moves the liquid discharging head in a scanning direction;

wherein the controller controls the liquid discharging head and the moving mechanism to discharge the liquid from the nozzles while causing the moving mechanism to move the liquid discharging head in the scanning direction, and to discharge a liquid droplet with a first volume dividedly at a plurality of times, as the value of the parameter becomes larger, while causing the moving mechanism to move the liquid discharging head in the scanning direction a plurality of times, instead of causing the liquid discharging head to discharge a liquid droplet with a second volume larger than the first volume while causing the moving mechanism to move the liquid discharging head in the scanning direction once.

10. The liquid discharging apparatus according to claim 1:

wherein the controller controls the liquid discharging head to decrease an amount of the liquid discharged from the liquid discharging head per unit time under a condition that the value of the parameter determined by the parameter determining mechanism exceeds a threshold value.

11. The liquid discharging apparatus according to claim 10;

wherein the liquid includes a plurality of color inks;

wherein the cartridge attaching section includes a plurality of individual cartridge attaching sections in which a plurality of liquid cartridges corresponding to the inks respectively are attached; and wherein the controller sets the threshold value separately for each of the color inks.

12. The liquid discharging apparatus according to claim 1;

wherein the liquid includes a pigment ink and a dye ink; and the parameter determining mechanism determines the value of the parameter according to whether the liquid is the pigment ink or the dye ink.

* * * * *